US006030476A

United States Patent [19]

Geddes et al.

[11] Patent Number: 6,030,476

[45] Date of Patent: Feb. 29, 2000

[54] INSULATED STOCK MATERIAL AND CONTAINERS AND METHODS OF MAKING THE SAME

[75] Inventors: Daniel James Geddes, Appleton; Michael Andrew Breining, Neenah; Michael Schmelzer, Appleton, all of Wis.

[73] Assignee: Fort James Corporation, Deerfield, Ill.

[21] Appl. No.: 08/834,039

[22] Filed: Apr. 11, 1997

Related U.S. Application Data

[62] Division of application No. 08/604,783, Feb. 23, 1996, Pat. No. 5,766,709.

[51] Int. Cl.[7] ..... B32B 5/18

[52] U.S. Cl. ..... 156/79; 156/78; 264/45.1; 264/45.6

[58] Field of Search ..... 156/78, 77, 79; 264/45.1, 45.6, DIG. 5; 229/3.1, 3.5 R; 428/35.7, 34.2, 36.5, 195, 913; 220/902, 903

[56] References Cited

U.S. PATENT DOCUMENTS

| | | | |
|---|---|---|---|
| 3,013,306 | 12/1961 | Richie et al. | 229/400 |
| 3,126,139 | 3/1964 | Schechter | 229/403 |
| 3,141,595 | 7/1964 | Edwards | 229/400 |
| 3,237,834 | 3/1966 | Davis et al. | 229/400 |
| 3,772,138 | 11/1973 | Witman | 156/79 |
| 3,779,298 | 12/1973 | Piccirilli et al. | 428/36.5 |
| 4,008,347 | 2/1977 | Amberg et al. | 428/36.5 |
| 4,435,344 | 3/1996 | Iioka | 264/45.1 |
| 4,878,970 | 11/1989 | Schubert et al. | 220/902 |
| 5,490,631 | 2/1996 | Ioka et al. | 229/403 |
| 5,547,124 | 8/1996 | Mueller | 229/403 |
| 5,766,709 | 6/1998 | Geddes et al. | 428/35.7 |
| 5,840,139 | 11/1998 | Geddes et al. | 156/29 |

FOREIGN PATENT DOCUMENTS

659647 A2 12/1994 European Pat. Off. .

*Primary Examiner*—Rena L. Dye

*Attorney, Agent, or Firm*—Sixbey, Friedman, Leedom & Ferguson, PC; Charles M. Leedom, Jr.; Donald R. Studebaker

[57] ABSTRACT

An insulating container comprising a container body having at least one side wall and a bottom wall with the side wall including a base layer, an insulating layer on at least a portion of the base layer and a printed pattern, mineral oil application or combination thereof on at least a portion of the surface of the insulating layer is disclosed wherein a thickness of the insulating layer is controlled by the printed pattern and/or mineral oil on the selected portion of the insulating layer. Similarly, stock material incorporating the present invention includes a base layer, an insulating layer formed on at least a portion of the base layer and a printed pattern printed on and or mineral oil applied to the insulating layer is disclosed wherein the thickness of the insulating layer is again controlled by the printed pattern and/or mineral oil on the portion of the insulating layer. The container may be formed of pre-manufactured stock material, by unexpanded stock material or by forming a container body from a paper or paperboard material including a bottom wall and at least one side wall, coating at least the side wall portion of the container body with a thermoplastic synthetic resin film and subsequently printing a pattern on the surface of the thermoplastic synthetic resin film. Once formed, the container is heated at a predetermined temperature for a predetermined time period sufficient to form a heat-insulating layer on the outer surface of the container by expanding the thermoplastic synthetic resin film. The expansion of the thermoplastic synthetic resin is controlled by a thickness of the printed pattern placed thereon, the mineral oil coating or a combination thereof.

6 Claims, 3 Drawing Sheets

FIG. 1
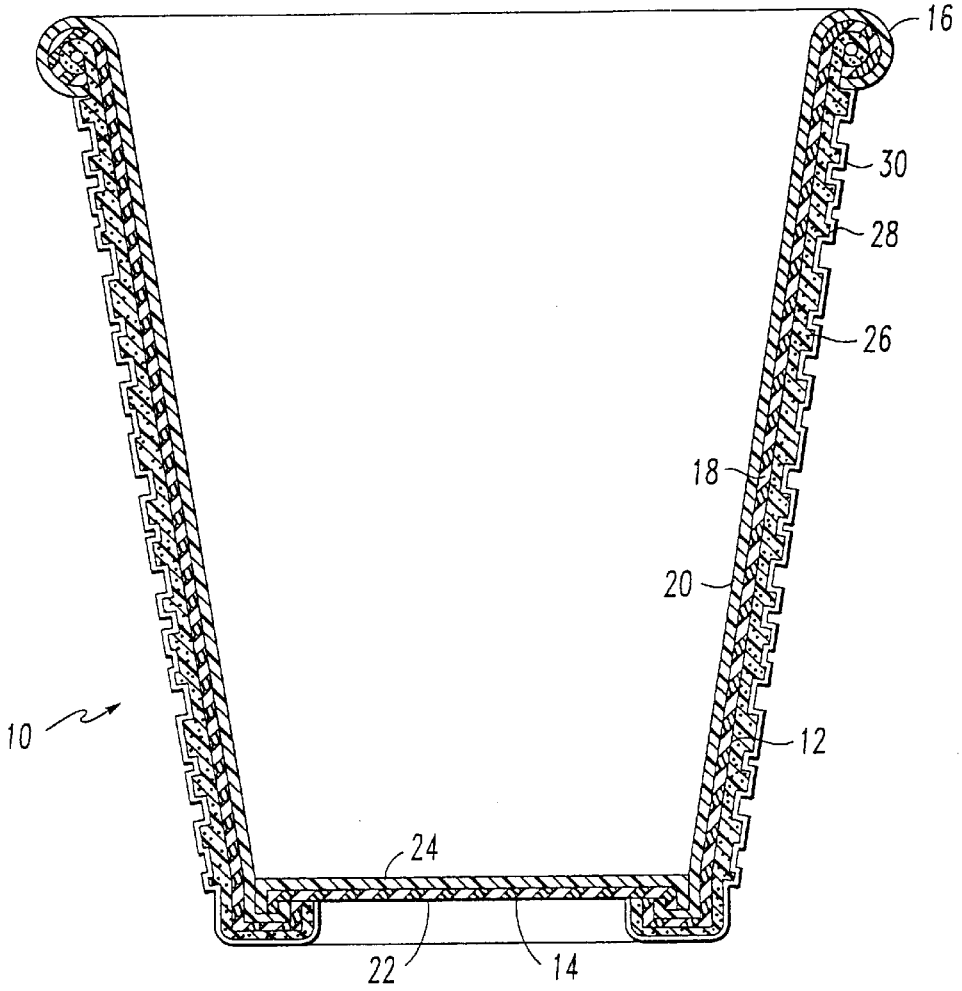
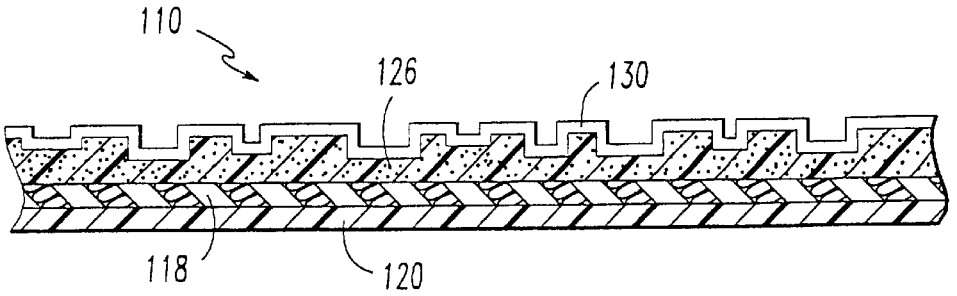
FIG. 2

FIG.6
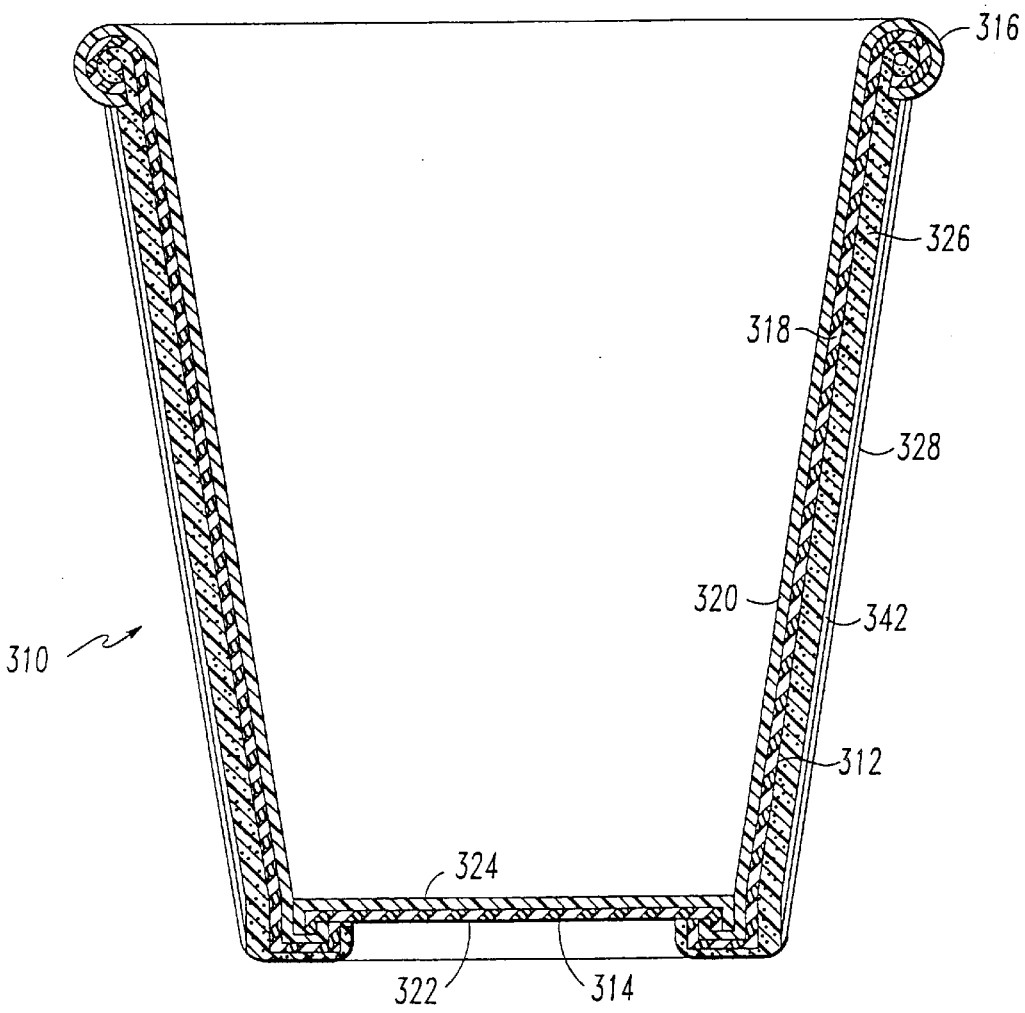
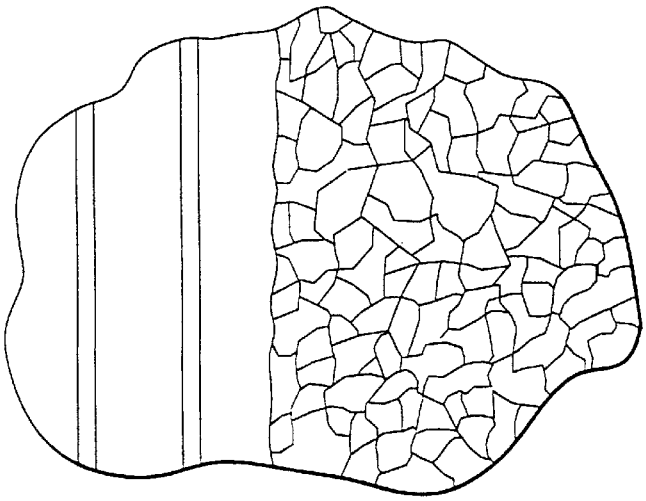
FIG.3

FIG.4
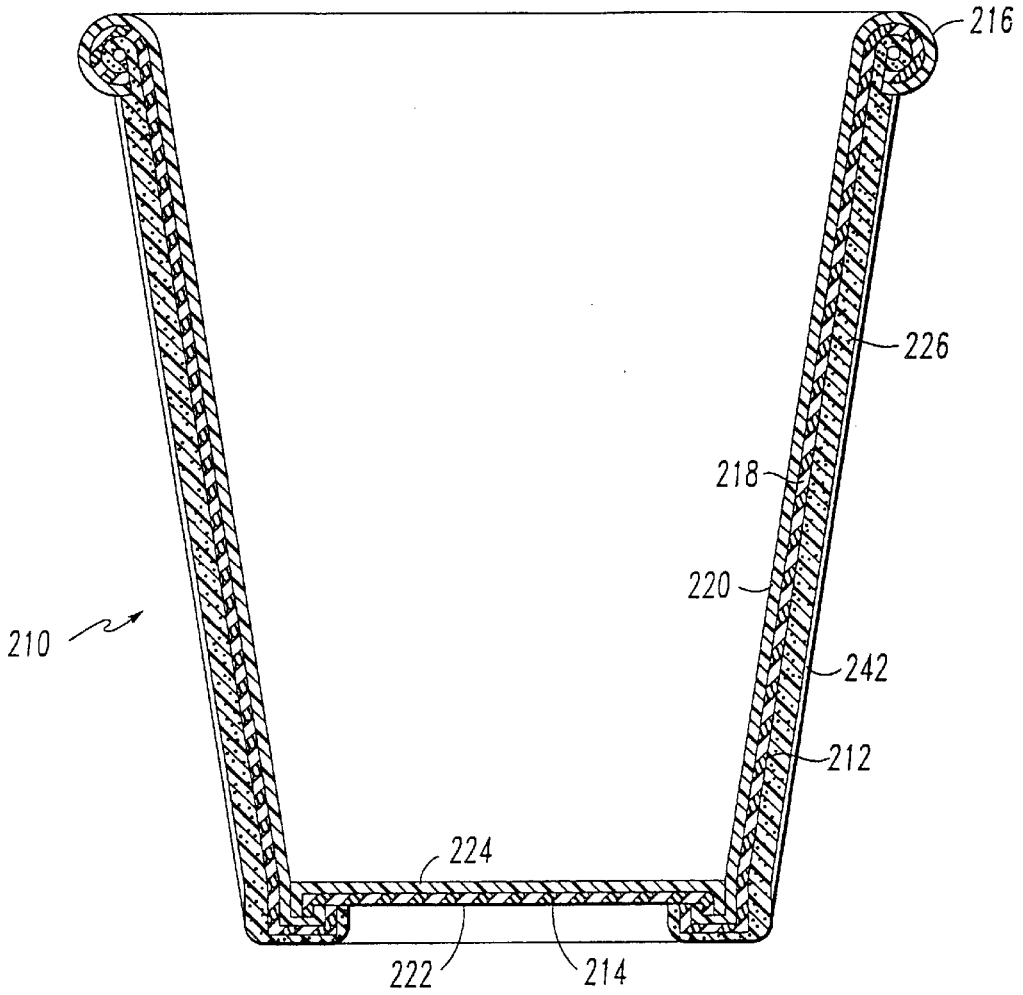
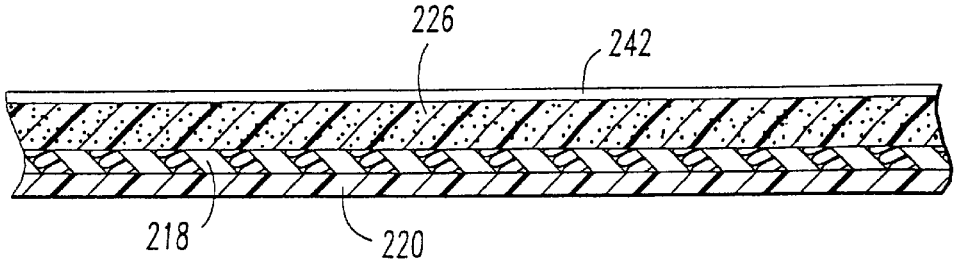
FIG.5

INSULATED STOCK MATERIAL AND CONTAINERS AND METHODS OF MAKING THE SAME

This is a Divisional application of Ser. No. 08/604,783, filed Feb. 23, 1996 now U.S. Pat. No. 5,766,709.

TECHNICAL FIELD OF THE INVENTION

The present invention relates to heat-insulating stock material and containers having a foamed layer of a thermoplastic film thereon and methods for producing the stock material and containers. More particularly, the present invention is directed to controlling the expansion of the foamed layer on the surface of the stock material or container.

BACKGROUND OF THE INVENTION

Several types of heat-insulating containers have been used commercially to pack hot liquids. A polystyrene foam heat-insulating container is one example. It is prepared by casting unfoamed polystyrene into a mold, heating the resin under pressure to foam it, and removing the foamed resin from the mold. Alternatively, a foamed styrene sheet may be shaped into a container. The container thus produced has outstanding heat-insulating properties but, on the other hand, it needs reconsideration from the viewpoint of saving petroleum resources or increasing the efficiency of incinerating waste containers. As a further problem, a slow, inefficient and high waste printing process is required to print on the outer surfaces of polystyrene foam heat-insulating containers since printing can only be effected after individual cups have been shaped. Further, the tapered surface of the container contributes to print flur at positions near the top and bottom of the container unless specialized and expensive printing technology is employed. As a further disadvantage, the outer surface of the foamed styrene heat-insulating container is often not sufficiently smooth to accept high resolution screen printing further affecting printability. Thus, the polystyrene foam containers suffer the disadvantage of low printability.

The conventional paper heat-insulating container can not be manufactured at low cost, and one reason is the complexity of the manufacturing process. One example is a container wherein the side wall of the body member is surrounded by a corrugated heat-insulating jacket. The process of manufacturing such container involves additional steps of forming the corrugated jacket and bonding it to the outer surface of the side wall of the body member. One defect of this type of container is that letters, figures or other symbols are printed on the corrugated surface and the resulting deformed letters or patterns do not have aesthetic appeal to consumers. Another defect is that the jacket is bonded to the side wall of the body member in such a manner that only the valley ridges contact the side wall, and the bond between the jacket and the side wall, and the bond between the jacket and the side wall is so weak that the two can easily separate. Often times, corrugated containers are not suitable for stacking and thus require large storage space.

Another type of paper heat-insulating container has a "dual" structure wherein an inner cup is given a different taper than an outer cup to form a heat-insulating air layer. The two cups are made integral by curling their respective upper portions into a rim. The side wall of the outer cap is flat and has high printability, however, the two cups may easily separate. Another disadvantage is that the dual structure increases the manufacturing cost.

U.S. Pat. No. 4,435,344 issued to Iioka teaches a heat-insulating paper container consisting of a body member and a bottom panel member, characterized in that at least one surface of the body member is coated or laminated with a foamed heat-insulating layer of a thermoplastic synthetic resin film whereas the other surface of the body member is coated or laminated with a thermoplastic synthetic resin film, a foamed heat-insulating layer of thermoplastic synthetic resin film or an aluminum foil. When manufacturing such a container, the water in the paper is vaporized upon heating, causing the thermoplastic synthetic resin film on the surface to foam. The container under consideration has the advantage that it exhibits fairly good heat-insulating properties and that it can be manufactured at low cost by a simple process. However, the thermoplastic synthetic resin film will not foam adequately if the water content in the paper is low. While high water content is advantageous for the purpose of film foaming, the mechanical strength of the container may deteriorate. Moreover, even if successful foaming is done, the thickness of the foam layer is uniform and cannot be controlled from one portion of the container to another. Further, the foam layer reaches an expansion limit regardless of the moisture content of the base layer.

In an effort to overcome the aforementioned shortcomings, U.S. Pat. No, 5,490,631 issued to Iioka discloses a heat-insulating paper container including a body wherein part of the outer surface of the body members provided with a printing of an organic solvent based ink. The body portion is subsequently coated with a thermoplastic synthetic resin film which when heated forms a thick foamed heat-insulating layer in the printed area of the outer surface whereas a less thick foamed heat-insulating layer is formed in the non-printed areas. Further, there are portions of the outer surface which remain unfoamed. In manufacturing a container in this manner, the printing is carried out on the paperboard layer and consequently viewing of the printed matter by the consumer is obstructed by the foamed insulating layer. Moreover, because the foamed layer overlying the printed areas are thicker than the remaining portions of the foamed layers, these areas will be even more obstructed. Consequently, this container suffers from similar drawbacks as those containers discussed hereinabove.

Accordingly, there is a need for insulated stock material and containers wherein the expansion of the foamed layer on the surface of the stock material or container is controlled and which includes printed matter which may be readily observed by the consumer while providing a container presenting an appearance of having been debossed or embossed.

SUMMARY OF THE INVENTION

A primary object of the present invention is to overcome the aforementioned shortcomings associated with the containers discussed hereinabove.

A further object of the present invention is to provide a heat-insulating container wherein the expansion of the insulating layer is controlled by way of printed matter on an outer surface of the heat-insulating layer.

Yet another object of the present invention is to provide a decorative heat-insulating container and stock material for forming the same wherein the container appears to be either debossed or embossed without actually carrying out such a process.

Yet another object of the present invention is to provide a heat-insulating container wherein the expansion of the heat-insulating layer is maximized.

Still another object of the present invention is to provide a heat-insulating container and stock material wherein the expansion of the foam layer is enhanced while still providing a smooth outer surface.

A still further object of the present invention is to provide a heat-insulating container and stock material for forming the same which includes not only enhanced foaming but further controls the foaming in selected areas so as to create the appearance of a debossed or embossed surface.

These as well as additional advantages of the present invention are achieved by forming an insulating container comprising a container body having at least one side wall and a bottom wall with the at least one side wall including a paper base layer, an insulating layer on at least a portion of the paper base layer and a printed pattern printed on at least a portion of the surface of the insulating layer wherein a thickness of the insulating layer is controlled by the printed pattern printed on the selected portion of the insulating layer. Similarly, stock material incorporating the present invention includes a base layer, an insulating layer formed on at least a portion of at least one surface of the base layer and a printed pattern printed on at least a portion of the surface of the insulating layer wherein the thickness of the insulating layer is again controlled by the printed pattern printed on the portion of the insulating layer. The container may be formed of pre-manufactured stock material by providing a base layer and applying a thermoplastic synthetic resin to at least a portion of the surface of the base layer and printing a pattern on at least a portion of the surface of the film. Subsequently, the stock material is heat treated such that the resin expands to form an insulating layer. During the heating of the stock material, the expansion of the resin is controlled by the layer of printed matter placed thereon. Alternatively, the container can be manufactured by either unexpanded stock material or may be manufactured by forming a container body from a paper or paperboard material including a bottom wall and at least one side wall, coating at least the side wall portion of the container body with a thermoplastic synthetic resin film and subsequently printing a pattern on the surface of the thermoplastic synthetic resin film. Once formed, the container is heated at a predetermined temperature for a predetermined time period sufficient to form a heat-insulating layer on the outer surface of the container by expanding the thermoplastic synthetic resin film. As discussed above, the expansion of the thermoplastic synthetic resin is controlled by the layer of printed matter placed thereon. Moreover, the thickness and other attributes of the printed pattern placed thereon can be varied so as to result in a container or stock material which exhibits a debossed or embossed appearance.

The expansion of the thermoplastic synthetic resin film can be further controlled by coating an exposed surface of the film with mineral oil or similar non-polar material. In areas where the film is coated, the expansion of the thermoplastic synthetic resin film is enhanced thus increasing the thickness of the foamed material without increasing the amount of resin applied to the base layer. Further, with the application of mineral oil, a smoother finished product is achieved.

Further, printed patterns and mineral oil coatings can be combined to create foamed heat-insulating layers of a variety of textures and thicknesses by controlling the expansion of the resin over areas of the container or stock material.

These as well as additional advantages of the present invention will become apparent from the following detailed description when read in light of the several figures.

BRIEF DESCRIPTION OF THE DRAWINGS

FIG. 1 is a cross-sectional view of a container formed in accordance with the present invention.

FIG. 2 is a cross-sectional view of stock material which may be used to form the container of FIG. 1 in accordance with one aspect of the present invention.

FIG. 3 is a partial view of the surface of the container illustrated in FIG. 1.

FIG. 4 is a cross-sectional view of a container formed in accordance with an alternative embodiment of the present invention.

FIG. 5 is a cross-sectional view of the stock material for manufacturing the container of FIG. 4 in accordance with another aspect of the present invention.

FIG. 6 is a cross-sectional view of a container formed in accordance with yet another alternative embodiment of the present invention.

DETAILED DESCRIPTION OF THE INVENTION

Referring now to the several figures, the present invention will now be described in greater detail hereinbelow.

With reference to FIG. 1, a container in the form of a heat-insulated cup 10 is illustrated and includes a side wall 12 and bottom wall 14. As is conventional, about an upper periphery of the side wall 12 is a brim 16 which readily receives a lid placed on the container and provides a comfortable feel to the consumer when consuming the contents of the container. Side wall 12 is formed of a plurality of layers. The base of which is a paper or paperboard layer 18. A film 20 is preferably formed on an inside surface of the paper layer 18 so as to form a liquid impermeable surface. This film may be of any known material and preferably is of a high density polyethylene material. The inner layer 20 has a dual purpose, the first being to prevent the penetration of liquid contents into the paper layer 18 as well as for assuring that what moisture content is in the paper layer 18 does not evaporate directly into the atmosphere during the heat treatment of the container as will be discussed in greater detail hereinbelow.

Similarly, the bottom wall 14 of the container is formed of a paper or paperboard layer 22 having an impermeable film 24 similar to that of film 20 formed on an inner surface thereof. The bottom wall 14 in conjunction with the side wall 12 thus forms a liquid impervious container for containing liquids to be consumed by the consumer.

Provided on an outer surface of the paper layer 18 is a foamed heat-insulating layer 26. Further, applied to an outer surface 28 of the foamed heat-insulating layer 26 is a printed layer 30. This printed layer may include multiple colors and may merely a random configuration or a specific design or logo as may be appreciated from FIG. 3.

With reference to FIG. 2, a cross-sectional view of stock material similar to that used in forming the container set forth in FIG. 1 is illustrated. Like the container 10, the stock material 110 includes a paper or paperboard layer 118 having on one surface thereof an impermeable film 120 such as high density polyethylene. While polyethylene is preferred, any known material which forms a moisture impervious barrier on the surface of the paper or paperboard layer 118 may be used.

On an opposing surface of the paper layer 118 is a foamed heat-insulating layer 126 which is preferably formed of a thermoplastic synthetic resin. These resin. These thermoplastic synthetic resin is a low to medium density polymers and may include but is not limited to polyethylene, polyolefin, polyvinyl chloride, polystyrene, polyester, nylon and other similar types of material. The paper or paperboard layer 118 as well as the paper layer 18 set forth in FIG. 1 may be of a basis weight of 50–300 pounds per 3,000 square foot ream of material and is preferably in the range of 90–200 pounds per 3,000 square foot ream. Further, because the moisture content of the paperboard material is important in forming the foam insulated layer, the moisture content of the paper or paperboard material is preferably at least about 2% and preferably within the range of about 2 to about 10%.

Applied to the surface of the foamed heat-insulating layer 126 is a printed layer 130 which may be a continuous multicolor layer or may be randomly printed on various portions of the heat-insulating layer 126. Expansion of the heat insulating layer is dictated by several properties of the ink in the printed layer 130. Among these attributes are the ink film thickness and binder composition. The greater the film thickness and binder resin strength, the more the inhibited the foaming of the heat insulating layer will be. The ink used in forming the printed layer 130 may be water based inks, however, any known ink may be used so long as the thickness of the printed layer and the strength attributes of the dried ink film can inhibit and dictate the range of expansion of the foamed heat-insulating layer 126. Additionally, for purposes of contributing to the insulation formation, "ink" as used herein may be a non-pigmented binder commonly known as varnish of extender.

When manufacturing the heat-insulating stock material, a paper or paperboard sheet is initially coated with high density polyethylene on one surface thereof and low density polyethylene on an opposing surface thereof. Applied to the low density polyethylene film is the printing which is printed in any known manner upon the low density polyethylene layer. Any pattern may be printed on the surface of the low density polyethylene film. The printed matter preferably includes heavily printed areas and light to non-printed areas such that variations in the surface of the foamed heat-insulating layer can be obtained. The stock material is then heat treated at a temperature and for a time sufficient to permit the thermoplastic synthetic resin film to foam and form the heat-insulating layer. Depending upon the melting point of the thermoplastic synthetic resin chosen, the material is heated at a temperature in the range of 200 to 400° F. for 50 seconds to 2½ minutes. Preferably, the material is heated at a temperature of 245° F. for 80 to 90 seconds.

In doing so, a unique texture is formed on an exposed surface of the material wherein the heavily printed areas appear to be "debossed" or sunken into the surface of the material. This is particularly apparent in the container of FIG. 1. The thickness in the heavily printed areas, areas having multiple layers of ink thereon, may be as little as ¼ the thickness of unprinted areas.

Microscopic examination of the cross-sections of the material show that the ink binder film, formed by printing, physically restrains the otherwise expanding nature of the thermoplastic synthetic resin. That is, in unprinted areas, the surface of the thermoplastic synthetic resin is able to expand freely to its maximum thickness while the printed areas, particularly the heavily printed areas, expansion of the resin is restrained or held back by the ink film.

In manufacturing the container illustrated in FIG. 1, a roll of paper or paperboard material is initially coated on one surface with a high density polymer having a high melting point and on an opposing surface with a low density polymer having a low melting point. Subsequently, a pattern is printed on the surface of the low density polymer in a known manner so as to provide a decorative appearance to the finished container. This pattern may include a random pattern or specific pattern such as words or logos as may be desired. Once the printed pattern is applied, the material is blanked in a known manner with the blanks being formed into containers of various configurations, one of which is illustrated in FIG. 1. Once formed, the container is heat treated at a temperature in the range of 200° F. to 400° F. in a manner similar to that set forth in U.S. Pat. No. 4,435,344. This permits the low density polymer to expand in a known manner with this expansion being controlled to various degrees by the printed pattern placed on the container. The resulted container thus exhibits the above-mentioned unique texture wherein heavily printed areas appeared to be "debossed" or sunken into the container surface. This provides a foamed insulated container of the type discussed herein, wherein the printed matter is not blurred or otherwise obscured and permits the printed matter to be on an outer surface of the container which heretofore has only been achieved by printing the container subsequent to its formation in expandable heat insulating containers. Such a printing process as discussed hereinabove in the background section of the invention is difficult and adds considerably to the manufacturing costs of the container.

Alternatively, the container of FIG. 1 may be formed from stock material similar to that illustrated in FIG. 3 wherein the material is heat-treated prior to being formed into the container. Additionally, a container may be manufactured with the low density and high density polymers being subsequently placed on the opposing surfaces of the container formed from paperboard stock material and the printed pattern being subsequently placed on the low density polymer before heat treating of the container, however, forming the container of preprinted material is preferred.

Referring now to FIGS. 4 and 5, an alternative embodiment of the present invention will be described in greater detail. As with the container illustrated in FIG. 1, the container 210 illustrated in FIG. 4 includes a side wall 212 and bottom wall 214. About an upper periphery of the container 210 is a brim 216 which performs the same function as the brim 16 illustrated in FIG. 1. The side wall 212 is formed of a paper or paperboard layer 218 having coated on an inner surface thereof an impermeable film 220. Again, this film is preferably formed of a high density polymer material and is impervious to moisture. Additionally, the bottom wall 214 includes a paper or paper board layer 222 having formed thereon a moisture impervious film 224 much like that of the previous embodiment.

As with the previous embodiment, the outer surface of the paper layer 218 is coated with a low density synthetic resin film 226 on an outer surface thereof. As discussed hereinabove, this low density thermoplastic synthetic resin film 226 when heated expands to form a heat-insulating layer. Further, a thin layer of mineral oil or other suitable non-polar material 242 is applied to the exposed surface of the low density synthetic resin film 226. FIG. 5 illustrates this concept as it may be applied to form stock material.

It has been found that by applying the mineral oil film 242 on the thermoplastic synthetic resin film 226, the expansion of the thermoplastic synthetic resin film 226 when heat treated is enhanced. This phenomenon was realized when attempting to determine why some portions of the film did not expand to the degree of other portions. It was initially thought that it was the mineral oil lubricant used to prevent scuffs in the polyethylene coating which inhibited the expansion of the resin when heat treated. In order to prove this theory, mineral oil was applied to an unprinted container having a thermoplastic synthetic resin film thereon to examine the foaming effects thereof. The container was then heat treated at 245° F. for approximately 90 seconds. Instead of realizing a reduction in the foaming of the thermoplastic synthetic resin film, unexpectedly, the portion of the container coated with mineral oil doubled in foaming thickness without causing large rough bubbles that are often realized when a container is over foamed. Accordingly, the added foam thickness would allow the thermoplastic synthetic resin film weight applied to the container to be reduced while still producing a requisite foam thickness thereby reducing production costs. Moreover, when applied in conjunction with that set forth in the previous embodiment, the use of mineral oil in areas having a printed layer or in areas having no printing layer can improve the foaming in these areas to create a texture representative of an embossed container.

Referring now to FIG. 6, a still further embodiment of the present invention is illustrated wherein a container 310 includes side wall 312 and bottom wall 314 which are formed in a manner similar to that discussed with respect to the embodiment set forth hereinabove. That is, the side wall includes a brim 316 formed about an upper periphery thereof and includes a base layer 318 formed of paper or paperboard material. Formed on an inner surface of the base layer 318 is an impervious film 320 formed preferably of high density polyethylene. Likewise, the bottom wall 314 includes a paper or paperboard layer 322 as well as an impermeable film 324 similar to that of layer 320.

Applied to an outer surface of the base layer 328 is a thermoplastic synthetic film 326 which as with the previous embodiments expands upon heat treatment thereof to form a heat-insulating layer. In order to enhance the expansion of the thermoplastic synthetic resin film 326, a film 342 of mineral oil or similar non-polar material is coated on an exposed surface thereof. As with the above-noted embodiment, the mineral oil penetrates the thermoplastic synthetic resin film and softens such film prior to heat treating thereof. It has been determined that when heat treated and the moisture within the paperboard material forces the thermoplastic synthetic resin to expand, because the thermoplastic synthetic resin has been soften by the mineral oil, the expansion in areas where the thermoplastic synthetic resin has been coated with mineral oil expands to a greater degree.

Likewise with the initial embodiment discussed hereinabove, the container 310 includes a printed pattern 328 as well. Accordingly, because the thickness of the printed pattern 328 acts to restrain the expansion of the thermoplastic synthetic resin layer 326 and the mineral oil layer 342 acts to enhance such expansion, the application as mineral oil as well as the printing of a printed pattern on an outer surface of the thermoplastic synthetic resin can be combined so as to control the overall expansion characteristics of the thermoplastic synthetic resin. In this regard, a container having either a debossed, embossed, or smooth appearance can be readily achieved. Moreover, by combining these coatings in various manners, the overall manufacturing costs of containers having a highly legible printed pattern thereon can be reduced.

In forming containers or stock materials in the manner discussed hereinabove, the shortcomings associated with prior art processes and containers discussed hereinabove are overcome. That is, a heat-insulating container wherein the expansion of the insulating layer is controlled by way of either the printing of a printed pattern on an outer surface of the heat-insulating layer, the application of mineral oil or similar material to the heat-insulating layer or a combination thereof is achieved.

While the present invention has been described in reference to preferred embodiments, it will be appreciated by those skilled in the art that the invention may be practiced otherwise than as specifically described herein without departing from the spirit and scope of the invention. It is, therefore, to be understood that the spirit and scope of the invention be only limited by the appended claims.

We claim:

1. A method of forming an insulated composite stock material comprising the steps of:

providing a base layer;

applying a thermoplastic synthetic resin film to at least a portion of a surface of said base layer;

printing a printed pattern on at least a portion of a surface of said film prior to heating; and heat treating the base layer having said film and said printed pattern thereon such that said resin expands to form an insulating layer;

wherein the expansion of said resin is controlled by said printed pattern.

2. The method as defined in claim 1, wherein the expansion of said thermoplastic synthetic resin is controlled by a thickness of said printed pattern.

3. The method as defined in claim 2, wherein the thickness of said printed pattern is varied over the surface of said film.

4. The method as defined in claim 1, wherein said base layer is a paper base layer.

5. The method as defined in claim 1, further comprising the step of forming the stock material into a container having at least one side wall and a bottom wall.

6. The method as defined in claim 1, wherein said base layer is a paperboard base layer.

* * * * *